United States Patent [19]

Bullard

[11] Patent Number: 4,865,020

[45] Date of Patent: Sep. 12, 1989

[54] APPARATUS AND METHOD FOR MOVEMENT OF BLOOD BY EXTERNAL PRESSURE

[76] Inventor: Horace Bullard, 3333 Henry Hudson Pkwy., Riverdale, N.Y. 10463

[21] Appl. No.: 230,339

[22] Filed: Aug. 9, 1988

Related U.S. Application Data

[63] Continuation-in-part of Ser. No. 67,497, Jun. 29, 1987, abandoned, which is a continuation-in-part of Ser. No. 881,774, Sep. 5, 1986, abandoned.

[51] Int. Cl.[4] ..... A61H 9/00

[52] U.S. Cl. ..... 128/64; 128/24 R

[58] Field of Search ..... 128/64, 40, 24 R

[56] References Cited

U.S. PATENT DOCUMENTS

| | | | |
|---|---|---|---|
| 1,608,239 | 11/1926 | Rosett | 128/64 |
| 2,781,041 | 2/1957 | Weinberg | 128/64 |
| 3,179,106 | 4/1965 | Meredith | 128/64 |
| 3,659,593 | 5/1972 | Vail | 128/64 |
| 3,811,431 | 5/1974 | Apstein | 128/64 |
| 3,862,629 | 1/1975 | Rotta | 128/64 |
| 3,866,604 | 2/1975 | Curless et al. | 128/64 |
| 3,942,518 | 3/1976 | Tentanz et al. | 128/64 |
| 4,013,069 | 3/1977 | Hasty | 128/64 |
| 4,253,449 | 3/1981 | Arkans et al. | 128/24 R |
| 4,311,135 | 1/1982 | Bruckner et al. | 128/24 R |
| 4,374,518 | 2/1983 | Vikanueva | 128/64 |
| 4,583,522 | 4/1986 | Aronne | 128/40 |
| 4,753,226 | 6/1988 | Zheng et al. | 128/64 |

FOREIGN PATENT DOCUMENTS

| | | | |
|---|---|---|---|
| 0026799 | 4/1981 | European Pat. Off. | 128/40 |
| 498943 | 4/1976 | U.S.S.R. | 128/64 |

*Primary Examiner*—Edgar S. Burr
*Assistant Examiner*—Tonya Lamb
*Attorney, Agent, or Firm*—Eliot S. Gerber

[57] ABSTRACT

In a program of regular vascular exercise involves repeating cycles of blood movement, for example, each vascular exercise period of one hour may involve twenty cycles. In each cycle pressurizing apparatus under control of a timing arrangement inflates and deflates a series of pressure cuffs around each limb, for example, each limb has seven cuffs. The cuffs at the limbs are inflated in sequence starting with the cuff nearest the limb extremity to provide a peristaltic-like action. The inflation of all the limb cuffs forces blood toward the trunk of the body. The trunk cuff is pulsed at the same time the limb cuffs are maintained inflated.

11 Claims, 7 Drawing Sheets

INFLATION-DEFLATION TIMING

APPARATUS AND METHOD FOR MOVEMENT OF BLOOD BY EXTERNAL PRESSURE

The present invention is a continuation-in-part application based upon application Ser. No. 07/067,497, filed June 29, 1987, now abandoned, which was a continuation-in-part application based upon Application Ser. No. 06/881,774, filed Sept. 5, 1986, now abandoned.

BACKGROUND OF THE INVENTION

1. Field of the Invention

The present invention relates to medical methods and apparatus and more specifically to a method and apparatus for vascular exercise by temporarily increasing the amount of blood in the trunk portion of a human body.

2. Description of the Related Art

Massaging of parts of the human body by a mechanical apparatus is shown, for example, in U.S. Pat. No. 3,908,642 for "Means for Aerating and Applying Air Pulsations Within Casts", which describes an arrangement of diaphragms or bladders that is installed within a cast. Pulsating air is forced through openings in the cast. The diaphragms or bladders receive the air coming through the openings and expand and contract with the pulses of air to escape therefrom. The expansion and contraction of the bladders in different locations beneath the cast massage the underlying muscles.

In U.S. Pat. No. 4,338,923 entitled "Inflatable-Cell Type Body Treading Apparatus", to Gelfer et al, an apparatus for the treatment of edema (accumulation of fluids in body tissues) consists of a band divided into inflatable cells. The band is placed on a limb and the cells are inflated in sequence to produce a pumping action toward the heart.

U.S. Pat. No. 3,811,431 entitled "Programmed Venous Assist Pump", to Apstein, and U.S. Pat. No. 4,311,135 entitled "Apparatus to Assist Leg Venous and Skin Circulation", to Brueckner et al, and U.S. Pat. No. 4,013,069 entitled "Sequential Intermittent Compression Device", to Hasty, a stocking or sleeve having inflatable chambers is placed on the legs and the chambers are sequentially inflated to move the blood toward the heart and prevent thrombophlebitis (blood clots) or pooling of venous blood in immobilized patients.

In U.S. Pat. No. 3,880,149 to Kawaguchi entitled "Blood Circulation Stimulating Apparatus", an air bag fits over the human body and the bag is inflated for 5–15 seconds and the cycle repeated.

In U.S. Pat. No. 3,659,593 to Vail, entitled "Cardiovascular Assist Device", high external pressure is applied to all extremities of the human body, using inflatable bladder cuffs, in sequence with the patient's cardiac cycle to raise aortic pulse pressure after the aortic valves have closed. There is no attempt to increase the amount of blood in the trunk, and to sustain the resulting increased pressure, by peristaltic movement of the blood toward the trunk.

U.S. Pat. No. 3,866,604 to Curless et al, entitled "External Cardiac Assistance", shows the application of peristaltic pumping to the legs of a patient to provide a diastole synchronized counterpulse in the aorta.

U.S. Pat. No. 3,179,106 to Meredith, entitled "Method and Apparatus For Preventing Venous Blood Clotting", shows inflatable bladders at the arms, legs and waist. The bladders are rapidly pulsed with short pulses of air.

It is believed known that pressure applied to an extremity of a human body can cause blood to flow toward the heart. For example, air bladders of the type used in blood pressure examinations are used on the legs or arms of patients, following heart operations, to temporarily reduce the veinal return to the heart, thereby reducing the pumping load on the heart. The bladders are inflated and deflected in a timed sequence.

The present invention provides an apparatus and method to improve blood movement, i.e., a vascular system exerciser, which is believed to be equal or superior in its beneficial effect to the vascular exercise obtained from vigorous exercise such as jogging; and which may be used by infirm or elderly persons. It is believed that increasing the amount of blood in the trunk of the body and holding the blood under pressure in the trunk and also, optionally, simultaneously applying pulsed pressure at the buttock area, can yield beneficial results. There are indications that the beneficial results include an improved capillary circulation, as shown by improved skin tone and improved functioning of the liver and lymph system. In addition, it is deduced that the system and method of the present invention may be useful in those conditions in which there is inadequate blood circulation, including Alzheimer's disease (lack of brain blood circulation), kidney malfunctions, and blood capillary circulatory problems, such as loss of hair color and loss of hair growth.

SUMMARY OF THE INVENTION

In accordance with the invention, there is provided medical apparatus comprising, in combination, pressure applying means (cuffs or bladders) which is applied around all four limbs of a person and about the buttock area. Actuating means coupled to the four limb pressure applying means controls the timing and the pressure. Each of the four limb pressure applying means has differentially actuatable sections, preferably inflatable cuffs, which are applied to a limb in an array extending along the limb. The actuating means has sequencing means for activating the limb sections to constrict each limb in a peristaltic-like sequence from the section nearest the limb extremity to the section nearest the trunk, forcing the blood toward the heart.

The following procedure is followed, preferably at least 4–6 weeks and preferably, like exercise, on a daily schedule for about one hour each day. Preferably, first each of the legs is placed under pressure, in sequence, and then each of the arms is placed under pressure, in sequence, and the pressure is held on all four limbs for at least 20 seconds, and less than 120 seconds. The buttock muscle exerciser bladder is pulsed with air pressure, preferably in another separate procedure as part of each cycle, while the pressure is held on all the limbs. Then the pressure is released. After 30 seconds to 60 seconds, the pressure is re-applied in the same sequence. This is repeated for 5–30 cycles, and preferably 20 cycles. The pressure is applied so that blood is placed under pressure in the trunk for 5 to 30 times each day.

In addition, preferably in another separate procedure as part of each cycle, the pressure applying means on the arms and legs are operated in the reverse direction with peristaltic-like sequence starting at the section nearest the trunk and progressing outwardly. For example, first the two arm pressure applying means are so operated, in sequence, to force the blood toward the hand, and held for at least 20 seconds and less than 120 seconds. Next the leg pressure applying means are operated, in sequence, to force blood toward the feet and the pressure held for 20–120 seconds.

BRIEF DESCRIPTION OF THE DRAWINGS

The invention will be better understood after reading the following detailed description of the presently preferred embodiments thereof with reference to the accompanying drawings, in which.

DETAILED DESCRIPTION OF THE PREFERRED EMBODIMENTS

Figure 1:
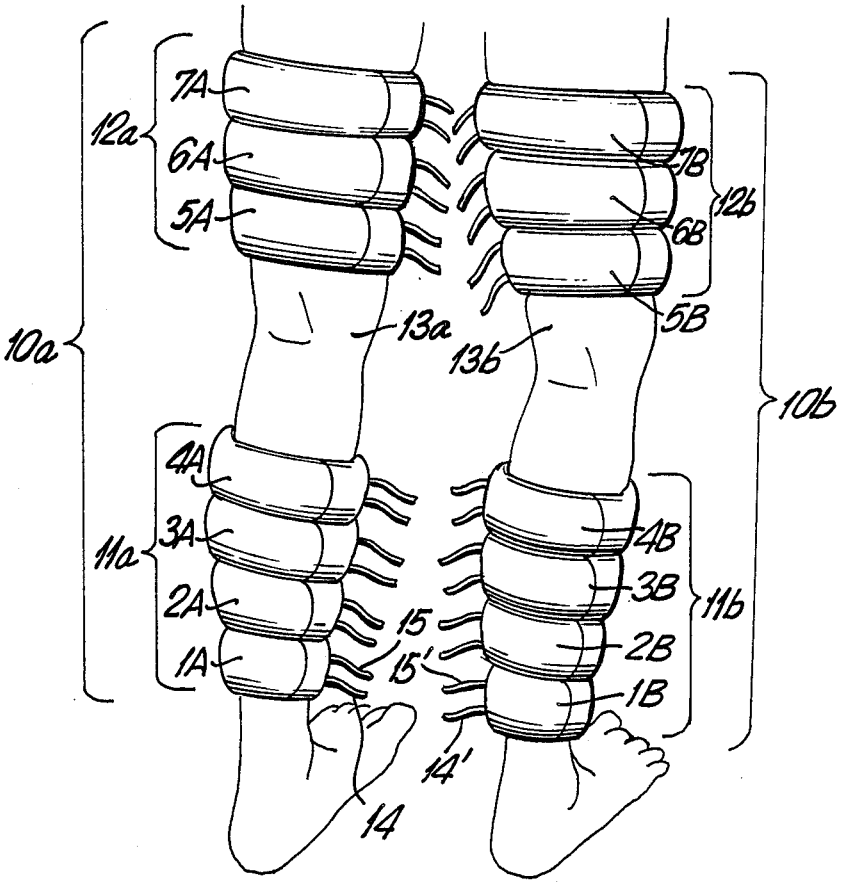
FIG. 1 is an illustration of the application of the pressure applying means, in the form of a series of pressure cuffs in arrays, to both legs of a human.
Figure 1A:
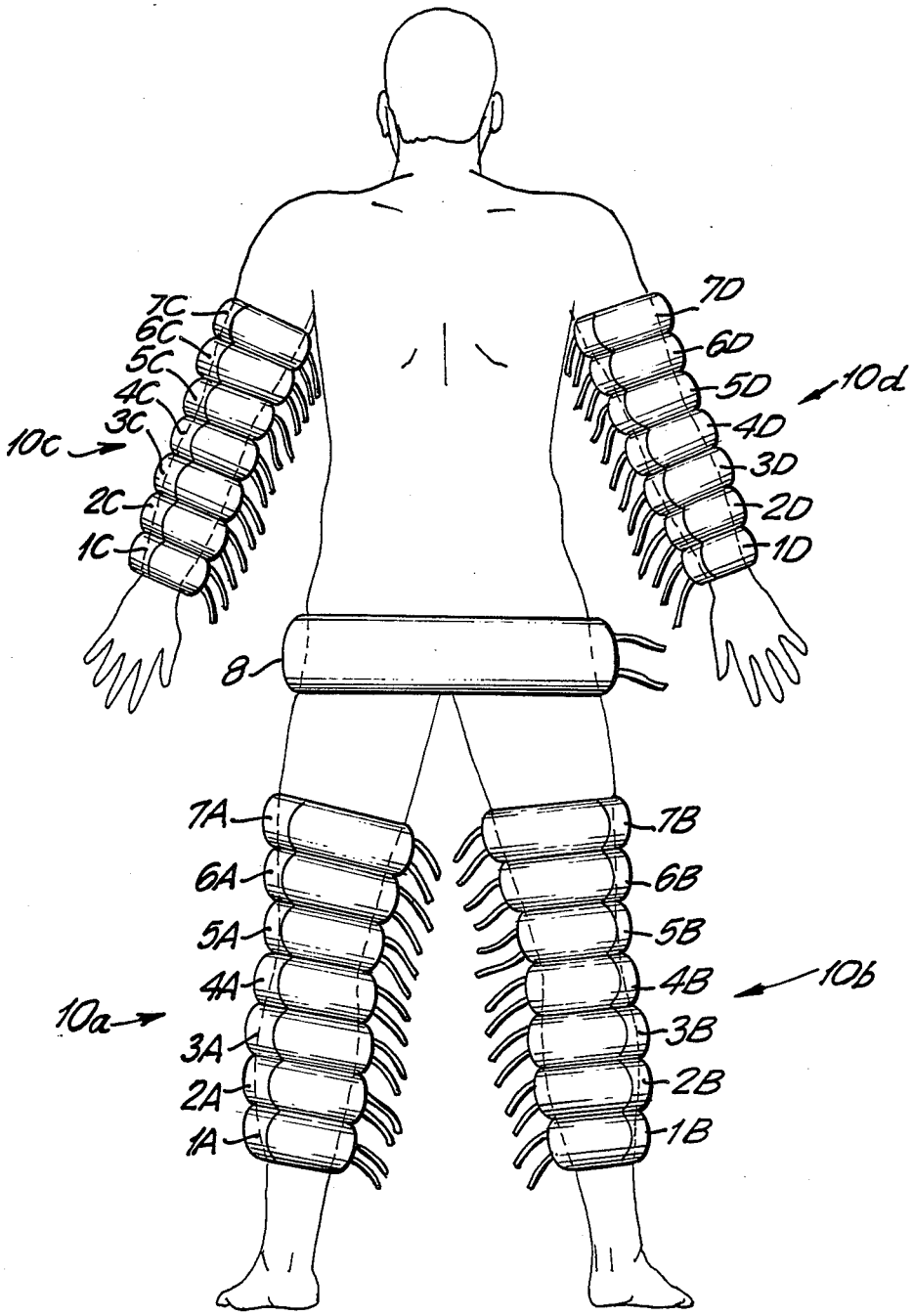
FIG. 1A is an illustration of the present invention applied to the legs and arms of a human.

As shown in FIG. 1A, four groups of pressure cuffs **10*a*–10*d* are applied to all four limbs of a person. The group of cuffs 10*a*, 10*b* are applied to the left and right legs, respectively, and the group of cuffs 10*c*, 10*d* are applied to the left and right arms, respectively. In the embodiment of FIG. 1A** each group of cuffs is not separated into two sets.

In addition, a large inflatable cuff (buttock exerciser) 8 is removably attached at the area of the buttocks. After the leg and arm cuffs are inflated, as explained below, causing the flow of blood toward the trunk and head of the body, their pressure is maintained for at least 20 seconds and preferably less than 60 seconds. At the time, while the pressure is maintained in the arm and leg cuffs, the buttock cuff 8 is inflated and pulsed with preferably 1–3 seconds on and off in repeated cycles, to provide cycles of pressure at the buttock area.

Although no further illustration of the pressure cuffs has been included, it is to be understood that each of the cuffs, identified by the numbers 1A to 7A, 1B to 7B, 1C to 7C and 1D to 7D, is similar to a sphygmomanometric cuff having an expandable bladder confined within a fabric binder that can be wrapped around the limb and held in place by a hook and loop fastener or the like. Each cuff, such as cuff 1A in set 10a, has connecting tubes 14 and 15, one for introducing pressurized air and the other for exhausting or venting the cuff. The cuffs may all be of the same basic size and rely upon the adjustment afforded by the fastener, or they may be sized to locate each in a specific position in the array. The function of the apparatus of FIG. 1A is to squeeze the blood from both legs and both arms into the trunk center, i.e., the center of the circulation system of the body. The process of squeezing is like the squeezing of a flexible tube of toothpaste with the cap on. If you squeeze from the bottom of the tube, the balance of the tube will expand. This is analogous to what the apparatus of FIG. 1A achieves in the human body by squeezing the blood from the legs and the arms toward the center of the body.

The process of squeezing starts at the bottom of the left leg when cuff (belt) 1A closes and inflates, squeezing the leg and forcing the blood out of that section of the leg. With cuff 1A staying closed and inflated, belt 2A closes and inflates, squeezing the left leg and forcing the blood out of that section of the leg. This process continues until all seven belts 1A–7A have inflated in the left leg. Then the belts 1B–7B of the right leg are inflated, in the same sequence, starting with 1B and ending with 7B. Then each of the arms, in turn, are squeezed in the same sequence and manner as the legs. It is important for all the belts to remain closed and inflated so that no blood can return to the legs or arms so that maximum pressure is maintained in the balance of the body, i.e., the trunk and head, until the cycle is over. Preferably complete closure is maintained for at least 20 seconds and less than one minute.

Preferably the following procedure is used daily, for about one hour a day, for at least 4–6 weeks before beneficial results may be seen. It should be used continually, on a daily basis, in the same manner as daily exercise. An hour is sufficient time for about 20 complete cycles, preferably the user should receive in the range of 10 to 30 complete cycles each day. A chart showing the preferred procedure of a single cycle is as follows (the numbers as in seconds):

| | | | | |
|---|---|---|---|---|
| 1. left leg-20 | right leg-20 | left arm-20 | right arm-20 | hold and buttock-60 |
| 2. right leg-20 | left arm-20 | right arm-20 | left leg-20 | hold and buttock-60 |
| 3. left arm-20 | left leg-20 | right leg-20 | left arm-20 | hold and buttock-60 |
| 4. right arm-20 | left leg-20 | right leg-20 | left arm-20 | hold and buttock-60 |
| 5. reverse | reverse | reverse | | reverse |
| left leg-20 | right leg-20 | left arm-20 | | right arm-20 |

The pressure is preferably 10–12 lbs/sq.in. The complete cycle above, consists of five sequence portions. In the first sequence 1, above, as shown in FIG. 1A, the cuffs 1A–7A are inflated in sequence starting with 1A and ending with 7A, which takes 20 seconds. The cuffs 1A–7A are then held inflated while the other three sets of cuffs are being inflated and during the "hold and buttock period". Consequently, in the first sequence the cuffs 1A–7A are held inflated, after being fully inflated, for 120 seconds. After the cuffs 1A–7A are fully inflated, the cuffs 1B to 7B are inflated in sequence, which takes 20 seconds. In this sequence the cuffs 1B–7B are held fully inflated for 100 seconds. Then cuffs 1C–7C are inflated, in sequence, and held fully inflated for 80 seconds. Then, the cuffs 1D to 7D are inflated, in sequence, and held fully inflated for 60 seconds. The four sets of cuffs 1A–7A, 1B–7B, 1C–7C, and 1D–7D are held fully inflated for 60 seconds during which second period the buttock bladder 8 is inflated and pulsed with air in 1–3 second bursts at 10–12 lbs/sq.in. (p.s.i.) pressure. At the end of the 60 seconds all the cuffs and the spinter bladder 8 are opened, releasing their air and deflating.

In sequence 5 above, the blood is forced to the limb extremities (hands and feet) to aid in blood circulation in those areas. For that purpose the cuffs are inflated in reverse peristaltic order, i.e., from the trunk toward the extremity. In sequence 5 above, the left leg cuffs are inflated in the order 7A to 1A and held for 20 seconds; the right leg cuffs are inflated in the order 7B to 1B and held for 20 seconds; the left arm cuffs are inflated in the order 7C to 1C and held inflated for 20 seconds and then the right arm cuffs are inflated in the order 7D to 1D and held inflate for 20 seconds. Each of the sets of cuffs is preferably deflated after the 20-second holding period, so that only one set is inflated at a time. Alternatively, the cuffs, during the reverse sequence, are held inflated while the other cuffs are being inflated. In this alternative, preferably the set of cuffs held inflated the longest are changed in order. For example, in sequence 10, not shown, the cuffs on the right leg are the first set of cuffs to be inflated in reverse order.

By analogy to the tube of toothpaste expanding because of the extra paste being squeezed from the bottom of the tube, the vascular system expands slightly because of the excess blood in the center of the body, i.e., trunk and head.

While the vessels are expanded, the circulatory system is still circulating blood through the vessels and the expansion of the vessels will loosen particles of cloggulation. The capillaries are the first to expand slightly and then the veins because they are larger and their walls are thicker. The capillaries in the kidneys, liver, spleen, adrenal glands, lungs, skin and others are all affected by this slight expansion and contraction. It is important to hold the cycle in the closed position, keeping the vessels expanded for at least 20 seconds.

Each kidney, for example, may have over one million nephrons, each having "glomerulus" (a group of capillaries with a total surface area of about 15 square feet which are intertwined with the tubules). The nephrons and tubules together are called the nephrons. As the blood passes through these capillaries, the blood is filtered. The liver has 50,000 lobules, which are a group of vessels and cell formation which filter the blood as it passes through the liver. It is important for these vessels to be free-flowing and not subject to particles of cloggulation. The increased pressure to the trunk region of the body may aid in the blood circulation through these vessels and improve their functioning.

Figure 2:
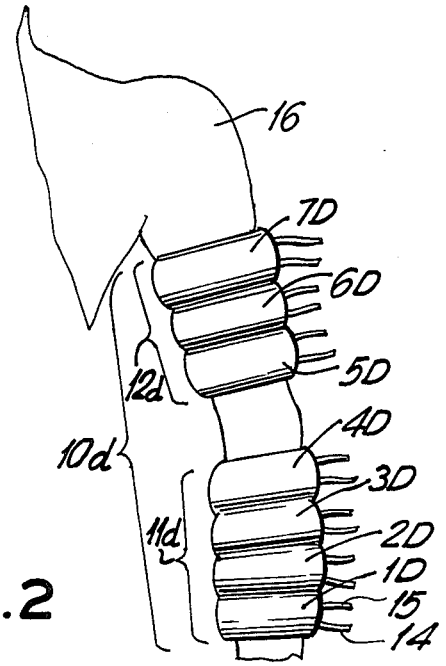
FIG. 2 is an illustration of the application of an array of pressure cuffs to an arm as a modification of that shown in FIG. 1.

Referring to FIG. 1, two groups 10*a* and 10*b*, of pressure cuffs, each group being separated into two sets 11*a*, 12*a* and 11*b*, 12*c*, respectively, are shown applied to the legs 13*a* and 13*b* of a human, the remainder of the body having been omitted in FIGS. 1 and 2. Of the two sets of pressure cuffs, it will be apparent that the sets 11*a* and 11*b* are applied below and the sets 12*a* and 12*b* are applied above the knee joint.

FIG. 2 shows the group 10*d* applied to an arm 16. Again, the set 11*d* is located below the elbow joint while the set 12*d* is located above the elbow. It should be understood that, although not shown in FIG. 2, the other arm of the subject would be fitted with the corresponding array of cuffs 1*c* to 7*c* similar to those applied to arm 16.

Figure 3:
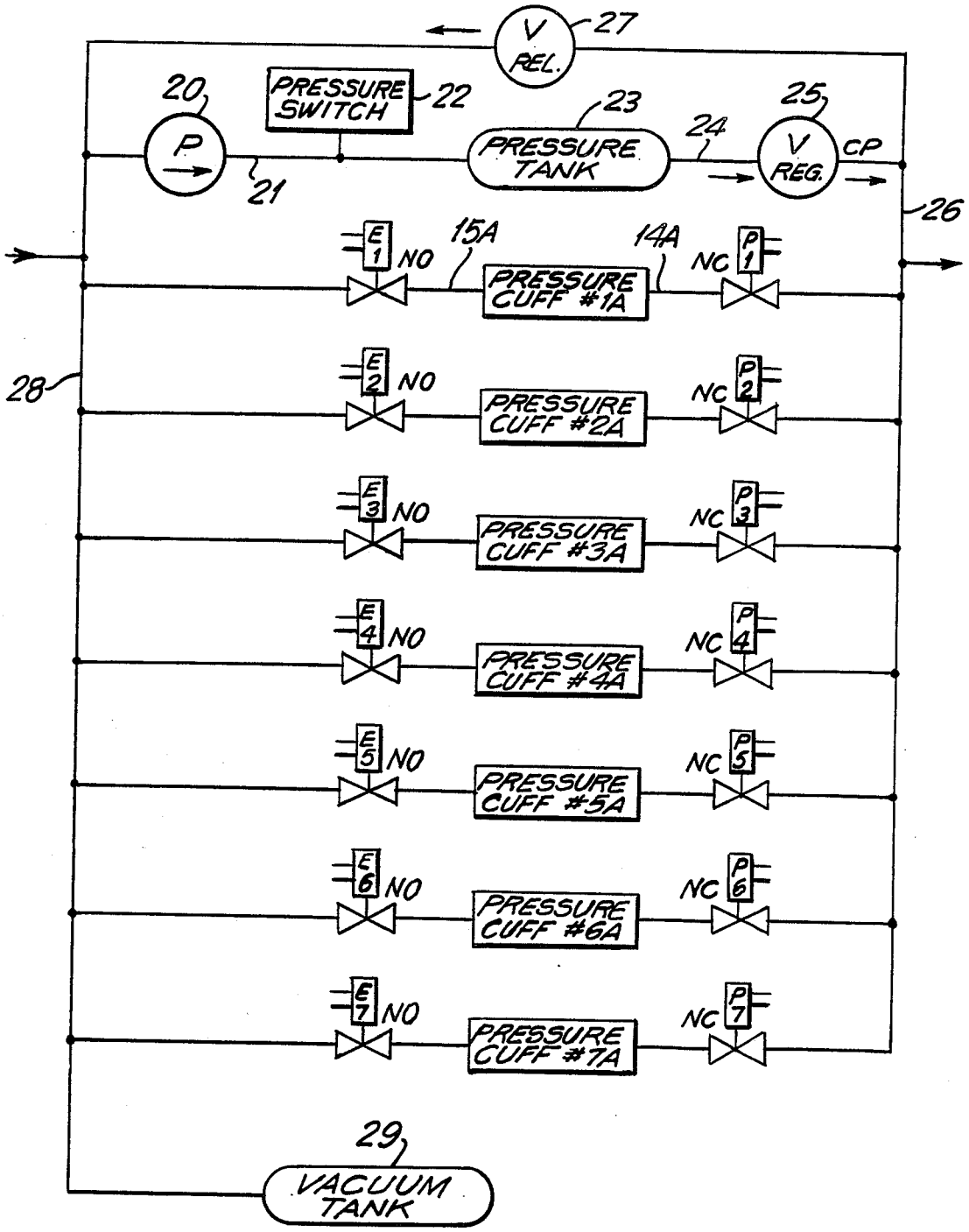
FIG. 3 is a schematic diagram of the pneumatic circuit for controlling the leg pressure cuffs shown in FIG. 1A.

Referring now to FIG. 3, there is shown the pneumatic circuit for the leg cuffs 1A–7A. A pump or compressor 20 has an outlet connected over a duct 21, to which is tapped a pressure switch 22, to an inlet to a pressure tank 23. An outlet from the tank 23 is connected by a duct or conduit 24 through a constant pressure regulator valve 25 to a conduit or head 26. To provide a margin of safety against the development of excess pressure in header 26, a pressure relief valve 27 is connected between header 26 and the input to pump 20, which input also connects with a conduit of header 28 terminating in a vacuum tank 29.

Figure 3A:
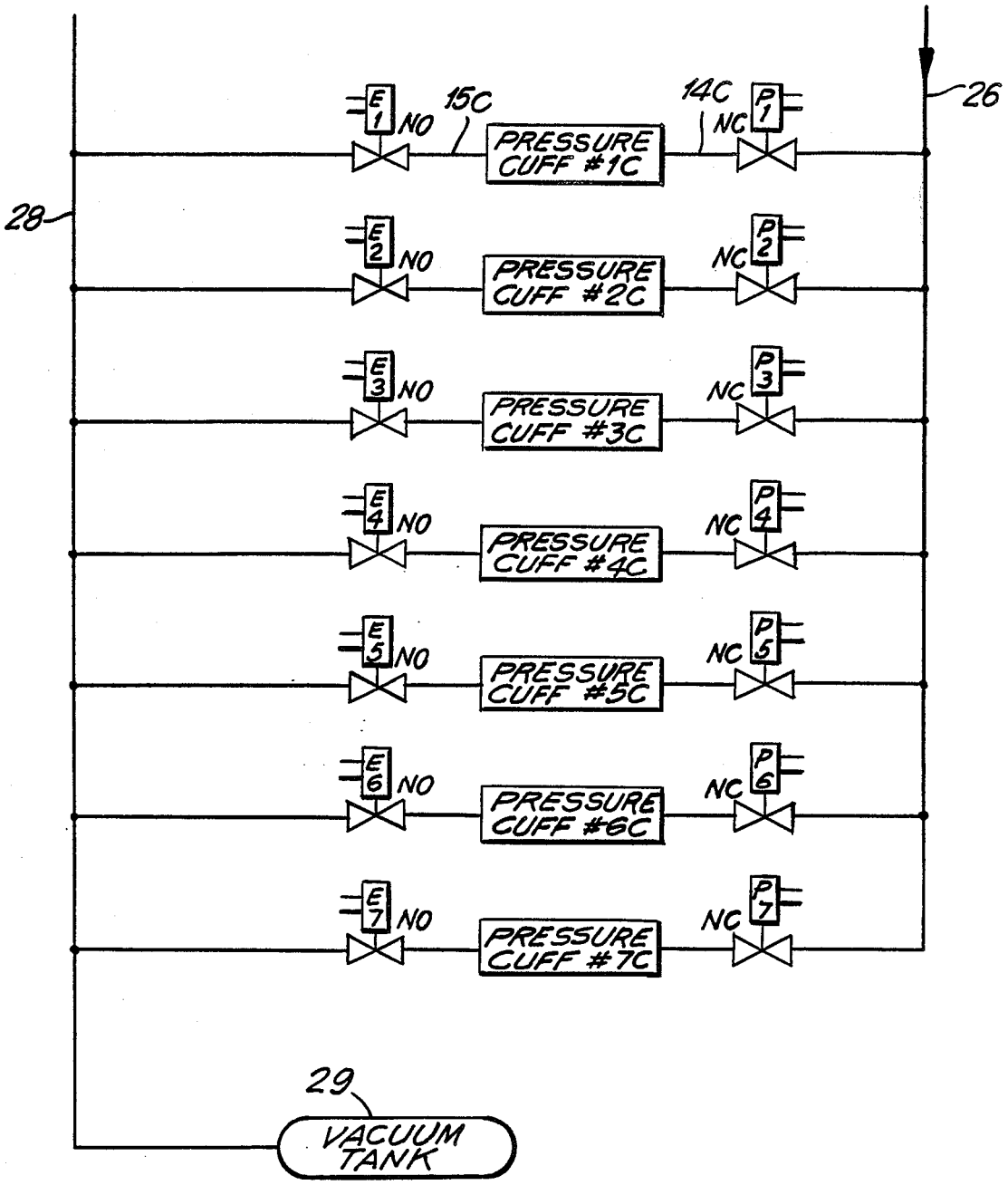
FIG. 3A is a schematic diagram of the pneumatic circuit for controlling the arm pressure cuffs shown in FIG. 1A.

The detailed description below relates to the control system for the leg cuffs 1A–7A. A similar arm cuff control system (see FIG. 3A) is used by the arm cuffs 1C–7C. Similar control systems (not shown) are used for the leg cuffs 1B–7B and arm cuffs 1D–7D. Preferably the leg cuffs 1A–7A and then 1B–7B are inflated, in sequence, and their inflation held. Subsequently the arm cuffs are inflated, in sequence, with cuffs 1C–7C inflated, and then cuffs 1D–7D, in sequence, until all the arm cuffs 1C–7C and 1D–7D are inflated.

The inlet 14A to cuff 1A is connected through a normally closed (NC) solenoid valve P1 to header 26. The outlet 15A from cuff 1A is connected through a normally olpen (NO) solenoid valve E1 to header 28. In similar manner cuffs 2A to 7A are joined and connected through respective solenoid valves P2 to P7 to header 26 and through respective solenoid valves E2 to E7 to header 28.

Figure 4:
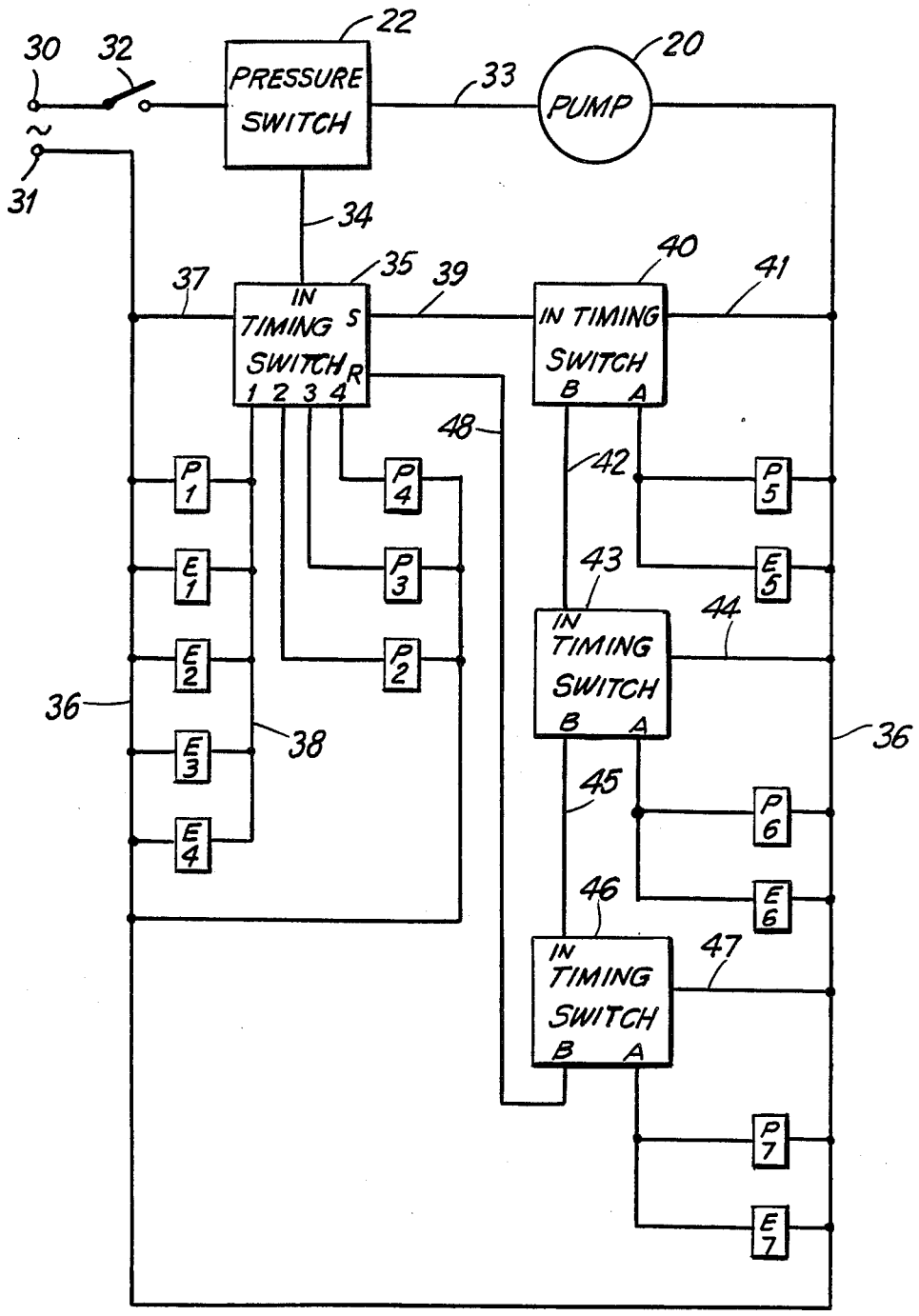
FIG. 4 is a schematic diagram of the electric circuit for controlling and operating the pneumatic circuit of FIG. 3.

The electric circuit for controlling the pneumatic components of FIG. 3 is shown in FIG. 4, to which attention should now be directed. A similar circuit (not shown) is used to control the pneumatic components of FIG. 3A. Input terminals 30 and 31 are provided for connection to a conventional source of electric power. The terminal 30 is connected through a main power switch 32 to the pressure switch 22 which, in turn, supplies power over connections 33 and 34 to the pump 20 and a timing switch 35. The return from pump 20 is over buss connection 36 back to terminal 31.

Timing switch 35, of any suitable construction, starts a timing cycle when power is applied over connection 34, the circuit being completed by a return connection 37 to a buss 36 and terminal 31. The timing switch 35 has five output terminals 1 to 5, and a reset terminal R. Output terminal 1 of switch 35 is connected over buss 38 to one input of each of the solenoids for valves P1, E1, E2, E3, and E4, the second input of each solenoid being connected to buss 36. In similar manner the solenoids for valves P2, P3 and P4 are connected between buss 36 and terminals 2, 3 and 4, respectively, of switch 35.

Output terminal 5 of switch 35 is connected over connection 39 to an output terminal of another timing switch, the switch 40, which is turned over connection 41 to buss 36. Timing switch 40 has only two switched outputs and these are labeled "A" and "B". The "A" output is connected to one input of each of the solenoids P5 and E5, the other input of each solenoid being connected to buss 36. The "B" output of switch 40 is connected over connection 42 to an input terminal of a third timing switch, the switch 43, which is returned over connection 44 to buss 36.

Switch 43, like switch 40, has an "A" output, and solenoids P6 and E6 are connected between the "A" output of switch 43 and buss 36. The "B" output of switch 43 is connected over connection 45 to an input terminal of yet another timing switch, the switch 46, the return to buss 36 being only by connection 47. Solenoids P7 and E7 are connected between buss 36 and terminal "A" of switch 36. Finally, the "B" output of switch 46 is connected over connection 48 to the reset terminal "B" of switch 35.

Figure 5:
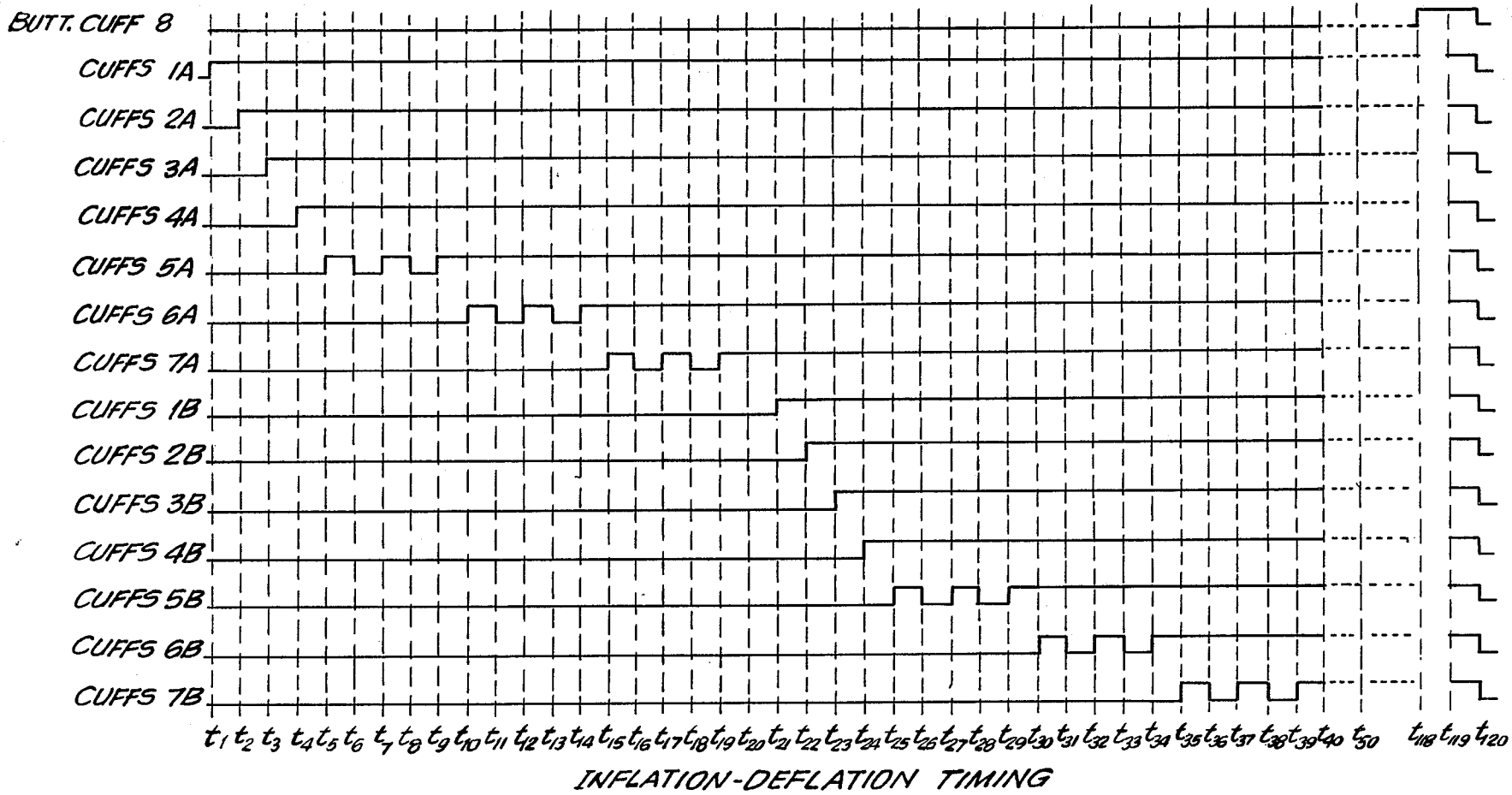
FIG. 5 is a timing chart showing the inflation-deflation intervals of the various pressure cuffs of FIG. 1A.

The operation of the apparatus will now be described with the aid of the timing diagrams in FIG. 5. After affixing the pressure cuffs to the arms and legs of the subject, the main power switch 32 is closed. Pressure switch 22 responds to the pneumatic pressure in the line 21 representing the pressure in tank 23. Assuming a tank at atmospheric pressure initially, a first switching element in pressure switch 22 will be closed to complete an electric circuit over line 33 to the pump 20. A separate switching element in pressure switch 22 will be in open condition, interrupting the power circuit to line 34. Hence, timing switch 35 will be deenergized and in its reset condition.

Pressure switch 22 can be of any suitable construction for opening the circuit to pump 20 when the pressure in tank 23 and line 21 reaches a predetermined level, e.g., 30 p.s.i. At some lower pressure level, the pressure to which pressure regulator 35 is set or slightly higher, e.g., 10 p.s.i., the pressure switch 22 closes the circuit to line 34 to start operation of timing switch 35. A constant pressure-reduction valve (not shown) is used to reduce the high pressure at the tank, for example, 30 p.s.i., to a lower pressure 10–12 p.s.i. which is fed to the cuffs. The pressure to the cuffs should not exceed 12 p.s.i. The section of pressure switch 22 that controls pump 20 has a low level setting to reclose and return power to pump 20 when the pressure in tank 23 falls a predetermined amount below the high pressure limit. The low level setting, of course, will be above the normal operating settings for the timer 35 and the pressure regulator 25. For example, the pump 20 can be re-activated when the pressure drops to 10 p.s.i.

When the timing switch 35 is energized, it will at time $t_1$ supply power via its terminal 1 to close the four normally open vent valves E1 to E4, and open the normally closed valve P1. Cuff 1A is now inflated. At time $t_2$ the switch 35 will supply power to its output terminal 2, maintaining power on its output terminal 2. Vent valve E2 remains closed and supply valve P2 is now opened to inflate cuff 2A. In similar fashion, cuff 3A is inflated at time $t_3$ and cuff 4A is inflated at time $t_4$. At this point in the operation, terminals 1 to 4 of switch 35 are all supplied with energizing current.

Next, at time $t_5$, switch 35 will close a circuit to its terminal 5 to supply power to timing switch 40 which is initially in a reset condition. Upon switch 35 reaching its terminal 5 output condition, switch 35 will remain so conditioned, supplying power to all of its five output terminals, until a resetting signal is received at terminal R.

Now, timing switch 40 commences a cycle of operation, closing a circuit to its terminal "A" at time $t_5$ to inflate cuff 5A by energizing valves E5 and P5. This closes vent valve E5 and opesn supply valve P5. At time $t_6$ the timing switch 40 is arranged to interrupt the supply of current to its terminal "A". This deenergizes valves P5 and E5, the latter opening while the former closes the vent cuff 5A.

It should be observed that pump 20 draws its air supply from vacuum tank 29. That is, while pump 20 is pressuring tank 23, it is simultaneously evacuating tank 29 and lowering the pressure therein. Therefore, when valve E5 is opened and pressurized, air in cuff 5A is rapidly withdrawn into tank 29. Valve E5 opens upon being deenergized at time $t_6$. Then at time $t_7$ the switch 40 once again completes the circuit to its terminal "A", reversing the conditions and reinflating cuff 5A. At time $t_8$ the circuit to terminal "A" of switch 40 is opened once again, and the cuff is deflated. Finally, switch 40 for the third time closes the circuit to valves P5 and E5 and cuffs 5A and 5B are reinflated. The next step for switch 40 is to complete a circuit to its terminal "B" while maintaining connection to its terminal "A".

Timing switches 43 and 46 are similar in construction and operation to switch 40. Therefore, it should be apparent that after switch 40 completes its cycle it energizes switch 43 which causes cuff 6A to be inflated three times with in-between deflation at times $t_{10}$ to $t_{14}$ going through a similar cycle followed by cuff 7A going through a similar cycle at times $t_{15}$ to $t_{19}$.

After the leg cuffs 1A–7A and 1B–7B are fully inflated, their inflation is held while the arm cuffs 1C–7C and 1D–7D are inflated. After all the cuffs are inflated, and held for at least 20 seconds, all the cuffs are simultaneously deflated at time $t_{40}$.

At time $t_{40}$ the switch 46 will complete the circuit to its output terminal "B" and via line 48 back to the "R" terminal of switch 35. At this time switch 35 is reset, interrupting the supply of current to all of its output terminals. Interruption of power to terminal 5 deenergizes all three timing switches 40, 43 and 46 which become reset and now no longer supply power to their "A" or "B" terminals. Therefore, all valves are deenergized and all of the pressure cuffs are deflated.

If the main power switch 32 is still closed and sufficient pressure exists in tank 23, timing switch 35 will start through another cycle and the complete system cycle will be repeated and continue to repeat until power switch 32 is opened.

It should now be apparent that the pressure cuffs are activated to constrict each arm and leg in a peristaltic-like sequence from the section nearest the extremity of the arm or leg, i.e., cuffs 1A–1D, to the section nearest the trunk of the body, i.e., cuffs 7A–7D. The cuffs 1A–4A, 1B–4B, etc. are constricted one after the other in immediate sequence while cuffs 5A–7A, 5B–7B, 5C–7C and 5D–7D undergo constriction a plurality of times before the succeeding cuff is actuated.

Figure 6:
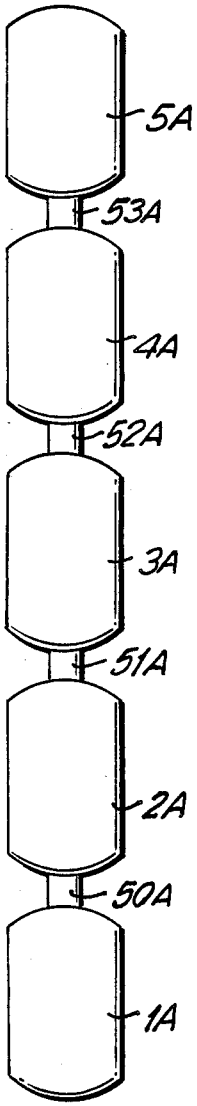
FIG. 6 is a diagram of a series of cuffs and the valves connecting each pair of cuffs.

An alternative system to inflate each cuff of the limb cuffs, in sequence, to form a constrictive peristaltic-like sequence is shown in FIGS. 6 and 7A–7C. FIG. 6 shows a series of air pressure bladder cuffs 1A–5A which would be used on the left leg. Air pressure operated valves 50A–53A are located between each cuff 1A–5A with valve 50A connecting cuffs 1A and 2A; valve 51A connecting cuffs 2A and 3A; valve 52A connecting cuffs 3A and 4A, and valve 53A connecting cuffs 4A and 5A. Preferably the same type of cuff inflating system is used on each limb, i.e., each of the one through fourth pressure applying means.

Figure 7A:
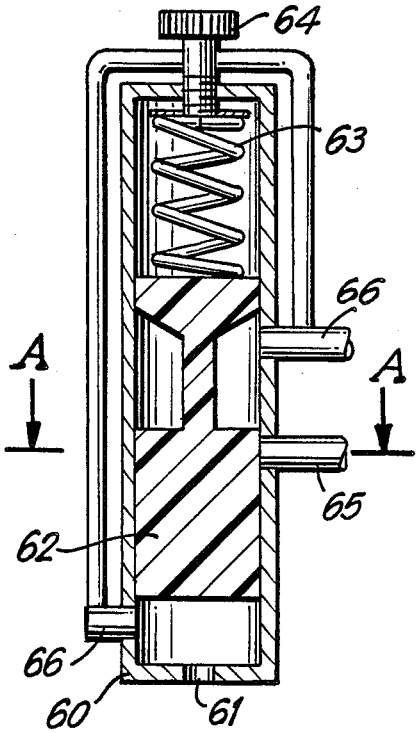
FIGS. 7A and 7B are side cross-sectional views of the type of valve used in FIG. 6.
Figure 7B:
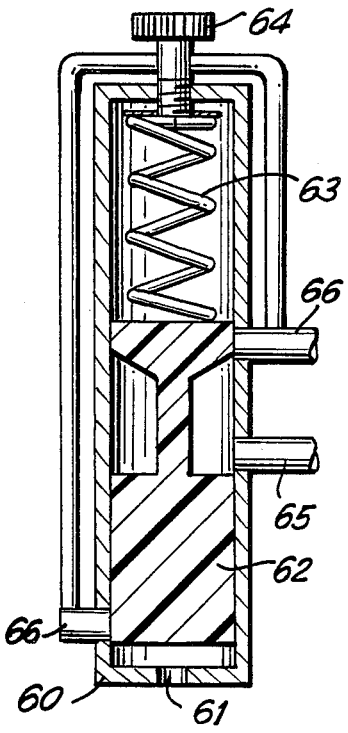
Figure 7C:
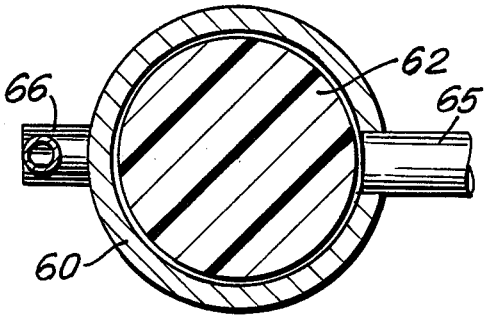
FIG. 7C is a top cross-sectional view of the valve shown in FIGS. 7A and 7B.

The valve structure of each of the valves 50A–53A is shown in FUGS. 7A–7C, the same structure being used in each valve. The valve 50A, including a hollow cylindrical case 60 having an air inlet port 61, through which pressurized air enters the valve. A plunger 62 is movable within the cylinder 60. The plunger is returned to its normal closed position by coil spring 63 which is adjusted by screw adjustment handle 64. The cylinder has two orifices in its side wall, a lower vent orifice 65 and an upper fill orifice 66. In operation, as shown in FIG. 7A, the pressurized air from a lower cuff (for example 1A) enters through orifice 61 and forces plunger 62 upward, compressing the spring 63 and closing that orifice 65. The air will flow around plunger 62 (see FIG. 7C) and flow though fill orifice 66 to fill up the next cuff (for example cuff 2A). When air pressure is released in the lower cuff (1A) the spring 63 returns plunger 60 to its normal position which opens vent orifice 65, thereby venting the cuff 2A.

Having described the present invention with reference to the presently preferred embodiments thereof, it should be understood that various changes in construction and operation can be effected by those skilled in the subject art without departing from the true spirit of the invention as defined in the appended claims.

I claim:

1. The method of vascular exercise and increasing the quantity of blood in the trunk of a human above the normal amoung by causing blood to flow from the legs and arms toward the trunk, including performing, within an exercise period of one hour or less, at least five vascular exercise cycles, each cycle comprising the steps of:

encircling the four limbs of a person with first to fourth pressure applying means, each of said pressure applying means having differentially actuatable sections extending in an array from an outermost section positioned along the limb toward the limb extremity to an innermost section toward a junction with the trunk, activating the sections in sequence to individually constrict each limb one at a time in a peristaltic-like sequence from the outermost to the innermost section and holding each limb constricted until all the limbs are constricted by all the sections simultanesouly and holding the constrictive activation of all the sections for a predetermined time greater than 20 seconds.

2. The method of claim 1 wherein the legs are placed under constrictive pressure in sequence, first one leg and then the other, by activation of all the sections encircling the legs and subsequently the arms are placed under constrictive pressure in sequence, first one arm and then the other, by activation of all the sections encircling the arms.

3. The method of claim 1 and including the further step, in each of said cycles, of applying a fifth pressure applying means to the buttock region and applying pressure to said buttock region during the predetermined time that all said sections are held activated.

4. The method of claim 3 wherein the pressure is applied by said fifth pressure applying means in a series of pulses of pressure.

5. Medical apparatus comrising in combination five pressure applying means, each of said first to fourth pressure applying means being adapted for encircling one of the four limbs of a person, each of said first to fourth pressure applying means having differentially actuatable section for application to said limb in an array extending along said limb between a limb extremity and a junction with the body trunk, and actuating means having sequencing mesans for constrictively activating said sections to individually constrict each limb one at a time in a peristaltic-like sequence from the section nearest said extremity to the section nearest said body and to hold each limb constricted until all the limbs are constricted and to then hold all of said sections constrictively actuated simultaneously for at least 20 seconds and to then deactivate all of said sections;

said fifth pressure applying means adapted for encircling the trunk of the person, and said actuating means activating said trunk pressure applying means after all of said sections have been constrictively activated and during the holding of said section.

6. Medical apparatus according to claim 5 wherein when each actuatable section of said first through fourth pressure applying means is constricted from a relaxed state all sections closer to said limb extremity are in a constricted state.

7. Medical apparatus according to claim 5, wherein said actuatable sections of said first through fifth pressure applying means comprise a plurality of inflatable bladder pressure cuffs, and said actuating means comprise for each said pressure cuff a separate solenoid controlled pressurizing valve and a separate solenoid controlled venting valve coupled to a respective inlet and outlet of said pressure cuff, a pressure regulated source of pressurized air coupled to all of said pressurizing valves, and a vacuum container coupled to all of said venting valves, and program means for actuating said valves in a controlled sequence.

8. Medical apparatus according to claim 5, wherein said fifth pressure applying means is an air bladder, and further including means to pulse the bladder of said fifth pressure applying means with bursts of air pressure.

9. Medical apparatus according to claim 5, wherein said actuatable sections comprise a plurality of inflatable bladders.

10. Medical apparatus according to claim 9, wherein each of said actuatable sections consist of at least four of said bladders adapted to be applied to said limb.

11. Medical apparatus according to claim 9, and further including air pressure valve means which connect each of the bladders within said first to fourth pressure applying means to each other, said valve means operating in sequence to permit air flow in sequence into each bladder.

* * * * *